US005361996A

United States Patent [19]

Svensson et al.

[11] Patent Number: 5,361,996

[45] Date of Patent: Nov. 8, 1994

[54] METHOD AND ARRANGEMENT FOR FINELY-GRINDING MINERALS

[75] Inventors: U. Krister Svensson; Conny L. Rehnvall, both of Sala, Sweden

[73] Assignee: Sala International AB, Sala, Sweden

[21] Appl. No.: 992,071

[22] Filed: Dec. 17, 1992

[30] Foreign Application Priority Data

Dec. 20, 1991 [SE] Sweden ..... 9103781-2

[51] Int. Cl.[5] ..... B02C 17/16

[52] U.S. Cl. ..... 241/30; 241/34; 241/171; 241/172

[58] Field of Search ..... 241/30, 34, 58, 60, 241/171, 172

[56] References Cited

U.S. PATENT DOCUMENTS

| | | | |
|---|---|---|---|
| 1,990,178 | 2/1935 | Frisch | 83/9 |
| 2,111,663 | 3/1938 | Graemiger | 83/44 |
| 2,136,907 | 11/1938 | Roder | 83/44 |
| 2,491,466 | 12/1949 | Adams | 241/34 |
| 2,498,089 | 2/1950 | Lippman | 23/278 |
| 2,602,594 | 7/1952 | Hesse | 241/19 |
| 3,149,789 | 9/1964 | Szegvari | 241/27 |
| 3,179,345 | 4/1965 | Kivert et al. | 241/30 |
| 3,739,911 | 6/1973 | Wehren et al. | 241/45 |
| 3,779,469 | 12/1973 | Putman | 241/30 |
| 3,860,804 | 1/1975 | Rutman | 235/151.1 |
| 3,957,210 | 5/1976 | Dürr | 241/46.02 |
| 4,244,531 | 1/1981 | Szegvari | 241/172 |
| 4,303,205 | 12/1981 | Geiger et al. | 241/17 |
| 4,382,557 | 5/1983 | Duerr | 241/1 |
| 4,660,776 | 4/1987 | Ikehuri et al. | 241/38 X |
| 4,673,134 | 6/1987 | Barthelmess | 241/57 |
| 4,850,541 | 7/1989 | Hagy | 241/171 |
| 4,979,686 | 12/1990 | Szegvari et al. | 241/172 |
| 4,998,678 | 3/1991 | Dürr | 241/171 |
| 5,133,506 | 7/1992 | Bogen | 241/46.17 |
| 5,242,122 | 9/1993 | Bogen | 241/34 X |

FOREIGN PATENT DOCUMENTS

| | | |
|---|---|---|
| 19834 | 12/1980 | European Pat. Off. . |
| 267170 | 5/1988 | European Pat. Off. . |
| 369149 | 5/1990 | European Pat. Off. . |
| 1607476 | 9/1969 | Germany . |
| 1607480 | 10/1969 | Germany . |
| 1957953 | 6/1971 | Germany . |
| 369679 | 9/1974 | Sweden . |
| 7312165 | 5/1978 | Sweden . |
| 1197582 | 7/1970 | United Kingdom . |

*Primary Examiner*—Douglas D. Watts
*Attorney, Agent, or Firm*—Nils H. Ljungman & Associates

[57] ABSTRACT

The invention relates to a method for finely grinding minerals and similar materials in an essentially dry state to particle sizes at which the ground material can be used as a filler. The method is characterized by effecting at least the final grinding phase in a closed grinding cavity that has been placed under a sub-pressure. The pressure in the grinding space shall preferably be lower than the prevailing ambient pressure by up to about 10 kPa.

The invention also relates to a mill having a grinding cavity that can be placed under a sub-pressure.

20 Claims, 1 Drawing Sheet

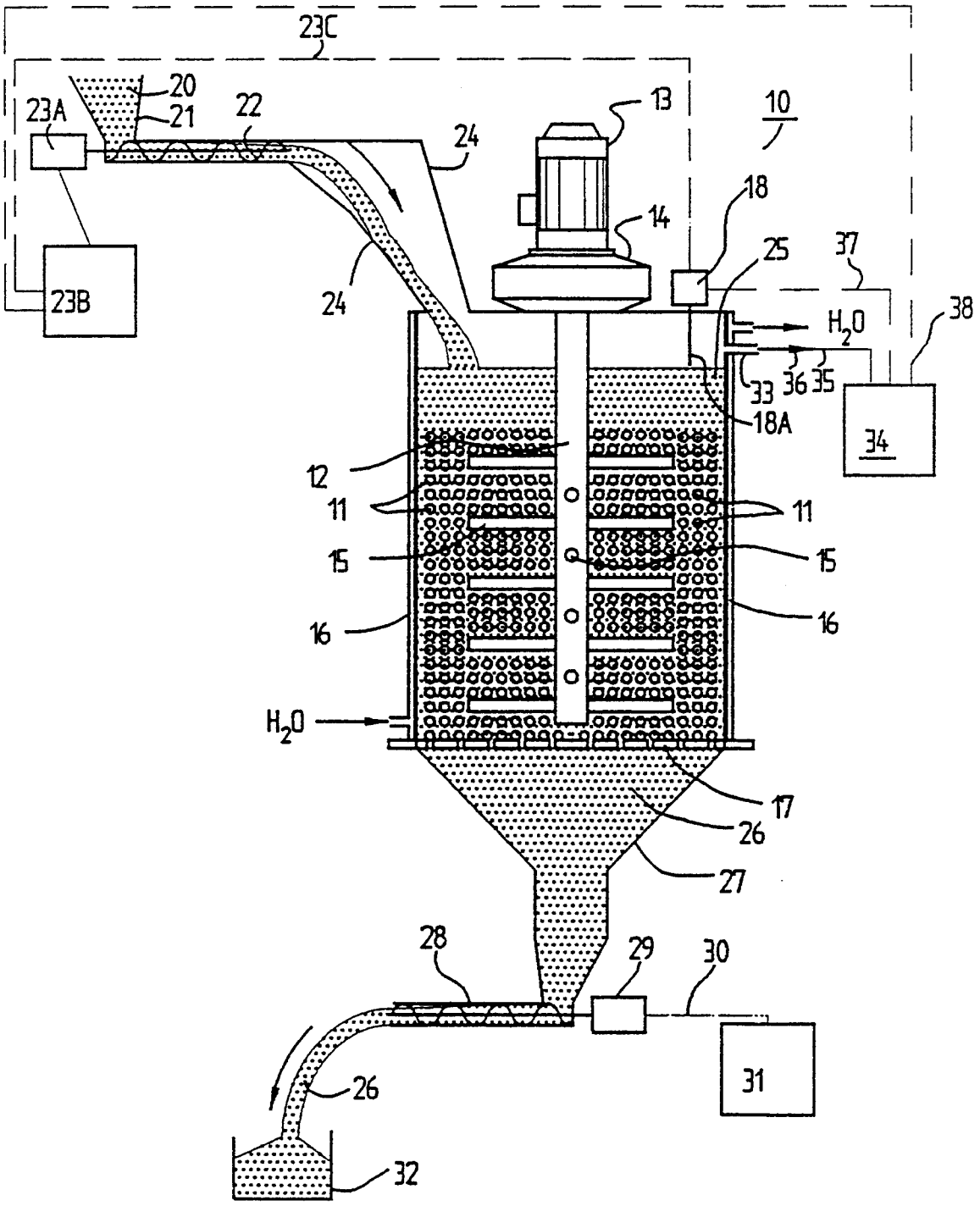
Fig.

METHOD AND ARRANGEMENT FOR FINELY-GRINDING MINERALS

BACKGROUND OF THE INVENTION

1. Field of the Invention

The present invention relates to a method pertaining to the fine-grinding of minerals and similar materials down to a particle size in which the finely ground material can be used suitably as a filler. The present invention also relates to a mill arrangement for use when carrying out the method.

2. Background Information

Minerals and similar materials intended for use as a filler in the production of different products, for example, in the manufacture of paper, plastics, paints, coatings, adhesive products and sealing materials, must have an average particle size which lies at least beneath 45 μm (97%). Furthermore, it is necessary that the material has a specific surface area corresponding to a Blaine-number greater than 400 $m^2/kg$. In the majority of cases, an average particle size smaller than 10 μm is required, for instance, when the material is used as a filler in paper and paints, while certain other applications require a still finer particle size, so-called ultra fine particles having an average particle size or grain size of <2 μm, for example, when the material is used as a filler in paper sizing coatings.

In certain cases, the filler material used for these purposes may comprise a precipitate which already has the desired particle size, or a particle size which lies close to the desired particle size, although filler materials are normally produced by a grinding process that includes a fine-grinding stage in which minerals or similar natural materials are ground to a desired particle fineness. Standard materials from which fillers are produced include different carbonate materials, such as lime stone or dolomite, different sulphate materials, such as gypsum, and silicon-based material, for example, clays such as kaolin. Fine-ground products of this kind cannot be produced readily by wet grinding processes, such processes being those normally applied for grinding materials down to desired fineness, since a wet-ground product needs to be subsequently dried. The fine material tends to lump together during this drying process and the resultant agglomerates need to be broken down in a further grinding process. The capital investment required herefor renders the wet-grinding alternative prohibitive in the majority of cases. In consequence, it is necessary to use a dry grinding process which, in the majority of cases, implies the use of a mill which operates with an agitated grinding medium, although it should be possible to use other grinding methods, at least in conjunction with smaller quantities of material, for instance batch wise grinding methods using steel or ceramic grinding bodies. The inventive method, however, is discussed below primarily with reference to an agitated grinding medium.

The technique of grinding down material with the aid of an agitated medium (Stirred Ball Milling) has been known to the art for almost 60 years. The technique had its industrial breakthrough in 1948, in conjunction with pigment grinding in the paint and lacquer industry. The technique has been developed progressively during recent years and has obtained increased application. As a result, many different types of grinding mills that use an agitated medium have been proposed, as is evident, for instance, from an article published in International Journal of Mineral Processing, 22 (1988), pages 431–444. One of these mills is equipped with pin agitator rotors, by means of which the requisite grinding energy is introduced by forced displacement of the grinding medium. Because the mill is able to grind material rapidly down to extremely fine-grain sizes, normally within the range of 1–10 μm, the technique of grinding with the aid of an agitated medium has been applied to an increasing extent for various types of material. For example, fine grinding of this nature is applied in the production of fine-grain products within the fields of paint and lacquer technology, pharmacology, electronics, agrochemistry, food-stuffs, biotechnology, rubber, coal and energy. Examples of this latter case include coal-oil-mixtures and coal-water-suspensions. The technique of grinding with an agitated medium is now also being applied within the mineral processing field. Examples of such application include the grinding of limestone, kaolin, gypsum, aluminium hydroxide and the manufacture of paper fillers and paper coating materials, as beforementioned.

The results of experiments and tests carried out in recent years have shown that when grinding with an agitated grinding medium, the fineness of the ground material is dependent solely on the specific energy input, which can be expressed in kWh/tonne of material ground. Furthermore, it is found that the advantages afforded by this grinding technique over the alternative techniques are greatly enhanced with increasing fineness of the ground material, in other words grinding with the aid of an agitated grinding medium becomes more attractive with the desired fineness of the end product. Thus, a finer end product requires a higher specific energy input, i.e. a higher specific power input and/or longer grinding time. Obviously, it is preferred primarily to try with a higher power input, so as not to influence the productivity of the mills concerned negatively. Grinding times of 6–8 hours, which have been suggested, for instance, in conjunction with the grinding of pyrites in South Africa, are naturally not so attractive, although in many cases necessary, since a higher power input would place even greater demands on the ability of the mill to withstand a harsh environment, particularly when grinding harder materials.

A suitable mill for grinding material down to extremely fine-grain products with high power inputs is described in our earlier publication EP-A-0 451 121, while a suitable continuous grinding method for application in such mills is described in SE-A-9100884-7 (EP-A-0506638).

One serious problem experienced when finely grinding materials in a dry state resides in the occurrence of a cladding or blocking phenomenon, the actual cause of which cannot be established precisely, but which is accentuated with the fineness of the grain sizes to be produced. This phenomenon is probably caused by newly formed fine grains baking together, as a result of a combination of different physical forces, for instance surface phenomena, van der Waals forces and the formation of condensate.

One method of attempting to counteract the aforesaid problem involves the addition of a liquid dispersant to the material being ground. The primary drawbacks associated with the use of a dispersant are, of course, the costs of the chemicals used and the unavoidable contamination of the finished product. The demands placed commercially on the quality of certain fine grain products are so strict as to render a product which is contaminated with a dispersant or reaction products of such dispersant totally unacceptable. Consequently, these products must be finely ground with the utmost of care, therewith inhibiting productivity, partly with the intention of attempting to minimize cladding and partly because of the actual cladding phenomenon itself.

OBJECT OF THE INVENTION

Consequently, there is a great need for an improved dry fine-grinding method, above all when manufacturing fillers, that is capable of eliminating the blocking and cladding problems which occur when the grain sizes of the grinding bodies approach the grain sizes of the end product. Such a method would be attractive both technically and economically and enable filler material to be produced for all conceivable applications.

SUMMARY OF THE INVENTION

It has now surprisingly been found possible to avoid the blocking and cladding problems that occur when dry fine-grinding minerals and similar materials, mentioned in the introduction, without requiring the addition of chemical substances.

The inventive method and arrangement are characterized by the steps and features set forth in the following method and apparatus claims.

Accordingly, at least the final phase of the inventive method is carried out in a closed grinding cavity which operates at sub-pressures. The sub-pressure in the grinding cavity is conveniently chosen so as to lie beneath the prevailing ambient pressure by up to about 10 kPa. The pressure in the grinding cavity can be chosen during the grinding process with regard to appropriate, directly measurable grinding parameters, for example the instantaneous throughflow of grinding medium or the current grinding energy. The sub-pressure is preferably created and maintained in the grinding cavity with the aid of a vacuum pump connected to said cavity. In many cases, the vacuum pump may have the form of a simple water-syphon, although larger mills may require the use of more powerful motor-driven pumps.

The inventive method can be carried out advantageously in a mill which uses agitated grinding medium and which may be provided with means for controlling and adjusting the residence time of the material in the mill, the through-flow capacity of the mill and the extent to which the mill is filled, as described in our earlier publication SE-A-9100884-7.

Although the reasons for the problems solved by the present invention and the solution of these problems cannot yet be explained theoretically, it has been found possible to make the fine grinding process much more effective when practising the invention, both with regard to improved throughflow of material in the continuous grinding mill and the improved use of the volumetric capacity of the grinding cavity.

In summary, the invention can be further characterized by the following paragraphs:

Paragraph A

One aspect of the invention resides in a method for finely grinding minerals and similar materials in an essentially dry state to particle sizes appropriate for use as a filler, characterized by carrying out at least the final phase of the fine grinding process in a closed grinding cavity that has been placed under sub-pressure.

Paragraph B

Another aspect of the invention resides in a method according to paragraph A, characterized by establishing in the grinding cavity a pressure which is lower than the prevailing ambient pressure by up to about 10 kPa.

Paragraph C

Yet another aspect of the invention resides in a method according to paragraphs 1 and 2, characterized by selecting the grinding cavity pressure during the grinding process with regard to the grinding process, for instance with regard to the relevant through-flow of ground material or grinding energy.

Paragraph D

A further aspect of the invention resides in a method according to paragraphs A–C, characterized by generating and maintaining the grinding cavity sub-pressure with the aid of a vacuum pump connected to the grinding cavity.

Paragraph E

A still further aspect of the invention resides in a method according to paragraphs A–D, characterized by effecting the grinding process in a mill that operates with agitated grinding media.

Paragraph F

An additional feature of the invention resides in a grinding mill for carrying out the fine-grinding method according to paragraphs A–E, characterized in that the mill includes a grinding cavity which can be placed under a sub-pressure.

BRIEF DESCRIPTION OF THE DRAWINGS

The inventive fine-grinding method will now be described in more detail with reference to the associated drawing, the single FIGURE of which illustrates the inventive method as carried out with the aid of a mill operating with an agitated grinding medium.

DESCRIPTION OF THE PREFERRED EMBODIMENTS

The illustrated apparatus includes a mill 10 which operates with agitated grinding medium 11 and which includes a rotor 12 driven by a motor 13 through the intermediary of a planet gear 14. The rotor 12 is provided with pins 15 which extend in four different directions substantially perpendicular to the rotor axis. The mill 10 is cooled by a water-filled jacket 16, to and from which water is continuously introduced and removed through respective inlets and outlets, as marked by the arrows designated $H_2O$. Fitted to the bottom part of the mill 10 is a metal bottom plate 17 having downwardly-conical circular openings which are adapted to hold the grinding media but which allow the ground material to pass through. Mounted on the upper part of the mill 10 is a level monitor 18, which may be provided with a forked sensor 18A.

Material 20 to be finely ground in the mill is fed, via a hopper 21, through a pressure-tight screw feeder 22, which is controlled to deliver a predetermined quantity of material to the mill with each unit of time, this control being effected by a drive means 23 comprised of a motor 23A and a speed-regulating device 23B. Signals can be transmitted from the level monitor 18 through a cable 23C, so as to interrupt the supply of material subsequent to the lapse of a given period of time after the level monitor 18 has indicated that the material 20 present in the mill 10 has reached its highest permitted level. The level monitor 18 may appropriately be provided with a clock which automatically produces a signal to commence feeding of material into the mill subsequent to the lapse of a predetermined time period. The material 20 is introduced into the mill 10 through a filling funnel 24 which is connected to the screw feeder 22 in an air tight fashion. It is ensured that only material 20 fed to the mill is present in the upper mill part 25, whereas the remainder of the mill 10 is also intended to include grinding medium 11. The ground material, referenced 26, is sieved from grinding medium on the bottom plate 17 and is transported in the form of a coherent flow of material through a funnel 27 and to a motor-driven pressure-tight discharge device 28, which in the illustrated case has the form of a screw feeder whose speed can be continuously adjusted. The screw feeder 28 is driven by a motor 29 whose speed is controlled by means of a control device 31, via a line 30. The control device 31 may have the form of a variator or a frequency converter.

Passing through the wall of the mill 10 is a connector pipe 33 which is intended for connection to a vacuum pump 34, as indicated by lines 35, wherein the arrow 36 indicates the outflow of gas (air) from the grinding cavity of the mill 10 as the pump 34 operates. The vacuum pump 34 can be started and stopped manually, and the subpressure is set manually to the level desired. However, it is also possible with the illustrated, preferred embodiment of the invention to automatize fully the actions of the vacuum pump, both with regard to starting and stopping of the pump and also with regard to setting of the desired pressure level. As illustrated by the broken lines 37, 38 the vacuum pump 34, or a pump operation control means (not shown), can be connected electrically to the level monitor 18 or to the speed control device 23B which functions to control the drive means, or to both the monitor and said means, so that impulses can be obtained from said monitor and said means in a predetermined manner.

In operation, outflow of finely-ground material 26 is first adjusted with the aid of the outfeed device 28, the motor 29 and the control device 31. The flow of ingoing material 20 is then adjusted, by adjusting the speed of the screw feeder 22 with the aid of the drive means 23A,B, so as to ensure that the level of the material in the upper part 25 of the mill 10 will increase in accordance with the selected infeed of material. When the infeed and outfeed flows of material have been set and finely adjusted in the aforedescribed manner, and the upper level of the material 20 reaches the sensor 18A of the level monitor 18, a signal-is sent from the level monitor 18 to the speed-regulating device 23B, through the cable 23C, causing the infeed of material 20 to be interrupted. After a given length of time has elapsed, the device 23B receives a further signal, in response to which the infeed of material is recommenced. Ground material 26 is discharged through the screw feeder 28 in an essentially constant, predetermined flow during the whole of the grinding process, this discharged, ground material 26 subsequently being collected in a storage container 32.

The vacuum pump 34 can be programmed to start and stop in response to signals from either the level monitor 18 or the drive device control means 23B, or from both said monitor and said means. It is also possible with the aid of the signals to set the grinding cavity to a desired sub-pressure with the aid of the vacuum pump, through the connecting pipe 33, so that the grinding process will be carried out constantly at an optimum sub-pressure. By optimum sub-pressure is meant the lowest sub-pressure required for acceptable throughput and/or grinding energy.

We claim:

1. A method for finely grinding minerals and similar materials in an essentially dry state to particle sizes appropriate for use as a filler, said method comprising:

providing a mill, the mill comprising a cavity for grinding materials therein;

closing the grinding cavity from air surrounding the mill by providing walls enclosing the cavity, said walls being configured to prevent flow of surrounding air through the grinding cavity;

providing means for providing a vacuum and reducing pressure within the closed grinding cavity;

carrying out at least a portion of the fine grinding process in the closed grinding cavity of the mill;

preventing flow of surrounding air through the grinding cavity during said at least a portion of the fine grinding process;

providing a vacuum and reducing a pressure within the closed grinding cavity of the mill to a pressure less than a prevailing ambient pressure during at least said portion of the fine grinding process to reduce clumping of materials during at least said portion of the fine grinding process; and reducing clumping of materials during at least said portion of the fine grinding process by said reducing of pressure within the closed grinding cavity.

2. A grinding mill for grinding minerals and similar materials in an essentially dry state, the mill comprising:

a grinding cavity, said grinding cavity comprising walls enclosing said grinding cavity, said walls comprising means for preventing air surrounding the mill from flowing through the grinding cavity;

means for introducing materials to be ground into the grinding cavity, said means for introducing materials comprising pressure-tight feeder means for feeding materials to be ground into the cavity;

means for grinding the materials in the grinding cavity to produce a ground material;

means for removing ground materials from the grinding cavity, said means for removing ground materials comprising pressure-tight feeder means for feeding ground materials out of the grinding cavity; and means for providing a vacuum and reducing a pressure in the grinding cavity to a pressure less than a prevailing ambient pressure during at least a portion of the grinding process.

3. The method according to claim 1, wherein:

said mill comprises a vertical mill, the vertical mill comprising a top, a bottom, first pressure-tight feeder means for feeding materials to be ground into the cavity, and second pressure-tight feeder means for feeding ground materials out of the grinding cavity; and said method further comprises the steps of:

feeding the raw material into the grinding cavity of the mill through the top of the mill with said first pressure-tight feeding means; and grinding the materials as the materials pass through the grinding cavity from the top of the mill to the bottom of the mill; and feeding the ground material out of the grinding cavity of the mill from the bottom of the mill with said second pressure-tight feeding means.

4. The method according to claim 3, wherein:

said at least a portion of the fine grinding process comprises at least a final grinding of the materials;

said reducing of the pressure within the grinding cavity comprises generating and maintaining the grinding cavity pressure less than the prevailing ambient pressure during said final grinding of the materials with the aid of a vacuum pump connected to the grinding cavity; and said grinding comprises grinding with an agitated grinding medium as the material to be ground moves from the top of the mill to the bottom of the mill.

5. The method according to claim 4, further including:

selecting the grinding cavity pressure during said at least a portion of the fine grinding process as a function of a parameter of the grinding process, said parameter comprising at least one of:

a level of material in the closed grinding cavity;

relevant through-flow of ground material through the closed grinding cavity; and grinding energy;

wherein said selecting comprises maintaining at least one of:

a predetermined through-flow of material through the grinding cavity, and a predetermined grinding energy, by adjusting said pressure in the cavity.

6. The method according to claim 5, wherein:

said feeding the raw material into the top of the mill comprises feeding the raw material into the top of the mill with a motor-driven, pressure-tight screw feeder;

said discharging of the ground material from the bottom of the mill comprises discharging the ground material from the bottom of the mill with a motor-driven, pressure-tight screw feeder;

said reducing of the pressure comprises reducing the pressure in the grinding cavity by as much as about 10 kilopascals lower than the prevailing ambient pressure during said final grinding of the materials; and said grinding comprises grinding the products to a particle size of less than about 2 micrometers.

7. The method according to claim 6, further including:

predetermining a stay time of the material in the cavity of the mill;

grinding the material in the cavity of the mill for the predetermined stay time at said pressure less than the prevailing ambient pressure; and maintaining the predetermined stay time:

partly by discharging ground material from the cavity of the mill at a predetermined, essentially constant rate; and partly by adjusting the infeed of material to the cavity of the mill in relation to the quantity of material discharged from the mill such that the amount of material present in the cavity of the mill will increase during the infeed of material thereto, and decreasing the infeed of material to the cavity of the mill when the level of the material in the cavity is over a predetermined highest level in the cavity of the mill.

8. The method according to claim 7, wherein:

said adjusting of the infeed of material comprises starting the infeed of material to the cavity of the mill upon a level of the material in the cavity reaching a predetermined first level; and said decreasing comprises stopping the infeed of material into the cavity of the mill upon the level of the material in the cavity reaching the predetermined highest level.

9. The method according to claim 1, wherein the material to be ground has air present therewithin, and the mill comprises no air inlets for admitting surrounding air into the grinding cavity, said method further comprises the steps of:

admitting air present in the material into the grinding cavity during feeding of material into the grinding cavity during said at least a portion of the grinding process; and admitting no additional surrounding air into the grinding cavity during said at least a portion of the grinding process.

10. The method according to claim 9, wherein:

said at least a portion of the fine grinding process comprises at least a final grinding of the materials;

said mill comprises a vertical mill, the vertical mill comprising a top, a bottom, first pressure-tight feeder means for feeding materials to be ground into the cavity; and second pressure-tight feeder means for feeding ground materials out of the grinding cavity; and said method further comprises the steps of:

feeding the raw material into the grinding cavity of the mill through the top of the mill with said first pressure-tight feeding means; and feeding the ground material out of the grinding cavity of the mill from the bottom of the mill with said second pressure-tight feeding means;

said reducing of the pressure within the grinding cavity comprises reducing the pressure in the grinding cavity by as much as about 10 kilopascals lower than the prevailing ambient pressure and maintaining the reduced grinding cavity pressure less than the prevailing ambient pressure with the aid of a vacuum pump connected to the grinding cavity;

said grinding comprises grinding the materials in the cavity of the mill with an agitated grinding medium as the material to be ground moves from the top of the mill to the bottom of the mill; and said grinding comprises grinding the material to particle sizes of less than about 2 micrometers.

11. The method according to claim 10, wherein:

said walls enclosing the grinding cavity comprise:

a vertical wall disposed about the sides of the grinding cavity;

a horizontal wall disposed across the top of the grinding cavity, said horizontal wall comprising an opening, said opening being connected to said first feeding means; and a conical wall disposed at the bottom of the grinding cavity, the conical wall comprising a first portion disposed adjacent the vertical wall and a second portion disposed away from the vertical wall, both of the first and second portions having a diameter, and the diameter of the second portion being less than the diameter of the first portion, said second portion comprising the bottom of the grinding cavity, and said second portion defining an opening through which said ground material is discharged from the cavity.

12. The grinding mill according to claim 2, wherein the material to be ground has air present therewithin, and said mill comprises:

a vertical mill, the vertical mill having a top and a bottom, and said vertical mill being configured for grinding the materials as the materials pass from the top of the mill to the bottom of the mill through the grinding cavity;

first pressure-tight feeder means for feeding materials to be ground into the grinding cavity through the top of the mill, the first pressure tight feeder means admitting air present in the material, along with the material, into the grinding cavity;

second pressure-tight feeder means for feeding ground materials out of the grinding cavity through the bottom of the mill; and no additional air inlets for admitting air, other than air present in the material, into the grinding cavity.

13. The grinding mill according to claim 12, wherein:

said grinding means comprises:

a grinding medium in the grinding cavity; and means for agitating the grinding medium;

said mill further comprises:

means for monitoring at least one of:

a level of material in the grinding cavity;

through-flow of material through the mill; and grinding energy; and means for automatically controlling said means for reducing the pressure within the cavity as function of said monitored at least one of:

a level of material in the grinding cavity;

through-flow of material through the mill; and grinding energy.

14. The grinding mill according to claim 13, wherein:

said first pressure-tight feeder means for feeding materials to be ground into the grinding cavity comprises a first motor-driven device;

said second pressure-tight feeder means for feeding ground materials out of the grinding cavity comprises a second motor driven device;

said mill further comprises:

means for adjusting a speed of said first motor-driven device;

means for adjusting a speed of said second motor-driven device; and a level monitor mounted in the cavity in the mill, said level monitor being connected to said means for adjusting a speed of said first motor-driven device to control the first motor-driven device as a function of the amount of material present in the mill.

15. The grinding mill according to claim 14, wherein:

said means for providing a vacuum and reducing pressure in the grinding cavity comprises means for reducing pressure in the grinding cavity to about 10 kilopascals less than prevailing ambient pressure;

said mill comprises means for maintaining the pressure of up to about 10 kilopascals below the prevailing ambient pressure within the grinding cavity of the mill;

said means for agitating the grinding medium comprises a motor-driven pin rotor, said pin rotor having a plurality of pins extending therefrom;

said first motor driven device and said second motor driven device comprise pressure-tight screw feeders;

said mill further comprises a perforated disc for isolating the grinding medium from the ground material leaving the mill; and said means for automatically controlling said means for reducing the pressure comprises:

means for electrically connecting said means for automatically controlling to at least one of:

said level monitor, and said means for for adjusting a speed of said first motor-driven device, to receive signals from said at least one of:

said level monitor, and said means for for adjusting a speed of said first motor-driven device, to control said means for reducing pressure.

16. The grinding mill according to claim 15, wherein:

said first and second motor driven devices comprises first and second screw feeders;

said means for controlling comprises means for starting and stopping the means for reducing pressure to control said means for reducing pressure;

said means for providing a vacuum and reducing pressure comprises one of:

a water-syphon vacuum pump; and a motor-driven vacuum pump;

said means for maintaining pressure of up to about 10 kilopascals below said prevailing ambient pressure within the mill comprises:

said walls enclosing said grinding cavity;

said pressure-tight screw feeders;

a filling funnel connected air-tight between said first pressure-tight screw feeder and said cavity to conduct material from said first motor-driven device to said cavity; and connecting means for connecting said cavity to said means for reducing pressure; said walls comprising:

a vertical wall disposed about the sides of the grinding cavity;

a horizontal wall disposed across the top of the grinding cavity, said horizontal wall comprising an opening, said opening being connected to said filling funnel; and a conical wall disposed at the bottom of the grinding cavity, the conical wall comprising a first portion disposed adjacent the vertical wall and a second portion disposed away from the vertical wall, both of the first and second portions having a diameter, and the diameter of the second portion being less than the diameter of the first portion, said second portion comprising the bottom of the grinding cavity, and said second portion defining an opening through which said ground material is discharged from the cavity;

said mill further comprises cooling means disposed adjacent said cavity for cooling said cavity during said grinding; and said cooling means comprising a water-filled jacket disposed about said grinding cavity, said water-filled jacket comprising means for flowing water through said jacket.

17. A method for finely grinding minerals and similar materials in an essentially dry state to particle sizes appropriate for use as a filler, said method comprising:

providing a mill, the mill comprising a cavity for grinding materials therewithin;

providing first pressure-tight feed means for feeding material to be ground into the cavity, said first pressure-tight feed means comprising a pressure-tight connection to the cavity to prevent surrounding air from entering the cavity;

providing second pressure-tight feed means for feeding ground material out of the cavity, said second pressure-tight feed means comprising a pressure-tight connection to the cavity to prevent surrounding air from entering the cavity;

providing vacuum producing means for reducing pressure within the grinding cavity, said vacuum producing means comprising a connection to the cavity, and said vacuum producing means comprising a connection to a vacuum source;

connecting each of said first pressure-tight feed means, said second pressure tight feed means and said vacuum source, to the grinding cavity;

substantially closing the grinding cavity, except for said connections for said first pressure-tight feed means, said second pressure-tight feed means and said vacuum producing means, from air surrounding the mill to substantially prevent surrounding air from entering into the grinding cavity and to substantially prevent flow of surrounding air through the grinding cavity;

reducing pressure within the grinding cavity of the mill to a pressure less than a prevailing ambient pressure during at least a portion of the fine grinding process by connecting the vacuum source to said connection of the cavity;

finely grinding the materials in the grinding cavity under reduced pressure;

substantially preventing flow of surrounding air into the grinding cavity during said fine grinding under reduced pressure; and reducing clumping of materials during said fine grinding by said reducing of a pressure within the grinding cavity.

18. The method according to claim 17, wherein:

said mill comprises a vertical mill, the vertical mill comprising a top, a bottom; and said method further comprises the steps of:

feeding the raw material into the grinding cavity of the mill through the top of the mill with said first pressure-tight feeding means; and grinding the materials as the materials pass through the grinding cavity from the top of the mill to the bottom of the mill; and feeding the ground material out of the grinding cavity of the mill from the bottom of the mill with said second pressure-tight feeding means.

19. The method according to claim 18, wherein:

said at least a portion of the fine grinding process comprises at least a final grinding of the materials;

said reducing of the pressure within the grinding cavity comprises generating and maintaining the grinding cavity pressure less than the prevailing ambient pressure during said final grinding of the materials with the aid of a vacuum pump connected to the grinding cavity; and said grinding comprises grinding with an agitated grinding medium as the material to be ground moves from the top of the mill to the bottom of the mill.

20. The method according to claim 19, wherein:

said feeding the raw material into the top of the mill comprises feeding the raw material into the top of the mill with a motor-driven, pressure-tight screw feeder;

said discharging of the ground material from the bottom of the mill comprises discharging the ground material from the bottom of the mill with a motor-driven, pressure-tight screw feeder;

said reducing of the pressure comprises reducing the pressure in the grinding cavity by as much as about 10 kilopascals lower than the prevailing ambient pressure during said final grinding of the materials; and said grinding comprises grinding the products to a particle size of less than about 2 micrometers.

* * * * *

UNITED STATES PATENT AND TRADEMARK OFFICE

CERTIFICATE OF CORRECTION

PATENT NO. : 5,361,996

DATED : November 8, 1994

INVENTOR(S) : Ulf Krister SVENSSON and Conny Lars REHNVALL

It is certified that error appears in the above-indentified patent and that said Letters Patent is hereby corrected as shown below:

In column 5, line 50, after 'a' delete "signal-is" and insert --signal is--.

Signed and Sealed this

Seventeenth Day of September, 1996

*Attest:*

*Attesting Officer*

BRUCE LEHMAN

*Commissioner of Patents and Trademarks*